United States Patent [19]

Horiya et al.

[11] Patent Number: 4,507,668

[45] Date of Patent: Mar. 26, 1985

[54] THERMAL PRINTER

[75] Inventors: Keiichi Horiya, Numazu; Tsugio Shiozaki, Susono; Koichiro Sato, Mishima, all of Japan

[73] Assignee: Tokyo Electric Company, Ltd., Tokyo, Japan

[21] Appl. No.: 536,344

[22] Filed: Sep. 27, 1983

[30] Foreign Application Priority Data

| | | | |
|---|---|---|---|
| Oct. 4, 1982 | [JP] | Japan | 57-174245 |
| Oct. 18, 1982 | [JP] | Japan | 57-182292 |
| Oct. 27, 1982 | [JP] | Japan | 57-189924 |

[51] Int. Cl.[3] ..... H05B 1/100

[52] U.S. Cl. ..... 346/76 PH; 400/120; 400/219

[58] Field of Search ..... 400/219, 219.1, 219.2, 400/219.3, 219.4, 219.5, 120, 249; 346/76 PH; 219/216 PH

[56] References Cited

U.S. PATENT DOCUMENTS

| | | | |
|---|---|---|---|
| 3,855,448 | 12/1974 | Hanagata et al. | 246/76 R |
| 4,025,830 | 5/1977 | Delaporte | 400/219.5 |
| 4,061,219 | 12/1977 | Nishikawa et al. | 400/219 |
| 4,313,683 | 2/1982 | Brown et al. | 400/249 |

*Primary Examiner*—E. A. Goldberg
*Assistant Examiner*—A. Evans
*Attorney, Agent, or Firm*—Frishauf, Holtz, Goodman & Woodward

[57] ABSTRACT

A thermal printer is provided, wherein a carrier having a thermal head mounted thereon is driven in both directions and a printing ribbon is fed in an amount necessary to print data in each printing operation. In this thermal printer, a ribbon drive means for driving the ribbon is provided separately from the carrier 20, thereby feeding the ribbon by the distance to be determined in accordance with the front end position of the unused portion of the ribbon and the length of the ribbon necessary to print the print data.

9 Claims, 24 Drawing Figures

FIG. 4
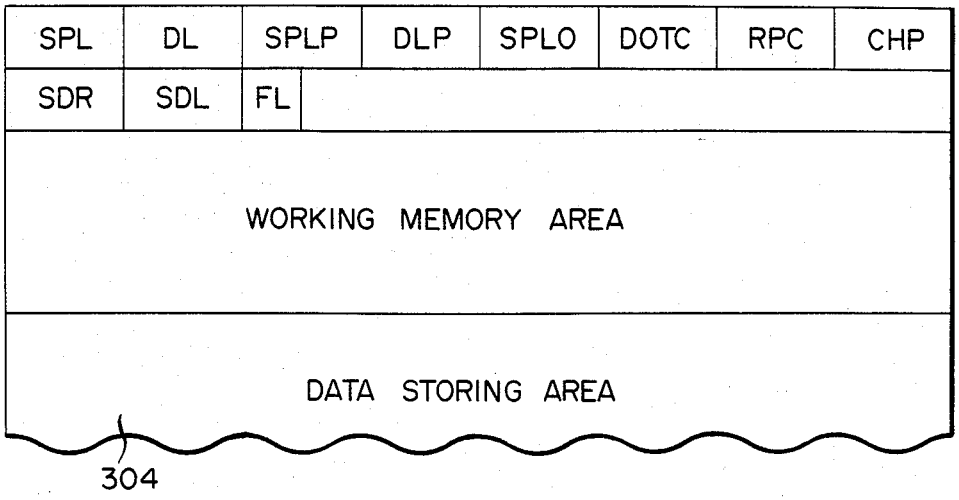
FIG. 5
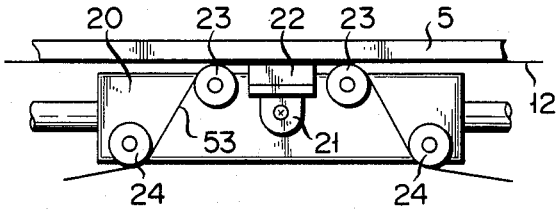
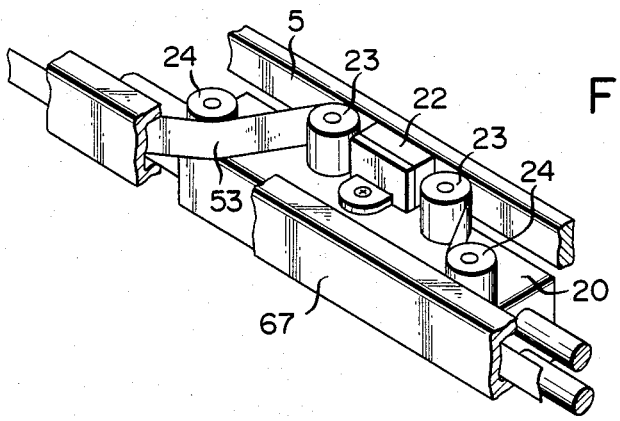
FIG. 6

THERMAL PRINTER

BACKGROUND OF THE INVENTION

The present invention relates to a thermal printer which employs a printing ribbon coated with a thermally melting ink.

Conventionally, there is known a thermal printer which prints data such as characters, alphanumeric characters, etc., on thermal paper by means of the heating elements of a thermal head. However, thermal paper must be used as the recording medium in thermal printers of this kind. Therefore, a thermal printer which makes it possible to use ordinary paper as a recording medium has been developed, whereby a printing ribbon on which a thermally melting ink has been coated is used and the melting ink on this printing ribbon is locally fused by means of the heating elements of the thermal head, thereby transferring the image to the recording paper. In the thermal printer of this kind, both the recording paper and printing ribbon must be relatively fixed, upon printing. To satisfy this condition, a mechanism for transferring the printing ribbon is mounted on a carrier which holds the thermal head; the printing ribbon is held in contact with the recording paper through rollers; and the printing ribbon, which is so adapted as to come into contact with the recording paper when the carrier is moved, is relatively fed in the reverse direction, against the thermal head, thereby eliminating the relative movement between the recording paper and the printing ribbon. The thermal printer of this type has drawbacks, however, in that the high speed printing operation is disturbed since a number of parts are attached to the carrier, and the total weight of the carrier and various attached parts is excessive. Moreover, since printing can be done only in a single direction of movement of the carrier, movement in the other direction is only utilized for the simple return operation. Therefore, the ratio of the effective printing time is low, which results in low efficiency.

SUMMARY OF THE INVENTION

One object of the present invention is to provide a thermal printer in which the printing operation can be performed efficiently and at a high speed.

This object may be accomplished by a thermal printer comprising a carrier drive unit for reciprocatingly driving a carrier within a predetermined range; a thermal head which is provided on this carrier and has a plurality of heating elements; a ribbon drive unit, provided separately from the carrier, for driving a printing ribbon coated with a thermally melting ink in a single direction, this printing ribbon being stretched to pass through between a recording medium and the thermal head; a print data generation circuit for generating print data for each line; a first memory for storing the print data from the print data generation circuit; a second memory for storing data corresponding to the length of the ribbon which is necessary to print the print data; a third memory for storing positional data representative of the head position of the unused portion of the ribbon; and a data processing circuit which applies a control signal to the ribbon drive unit, in accordance with the contents of the second and third memories, to feed the ribbon by a distance determined by the contents of the second and third memories, applies a control signal to the carrier drive unit to set the thermal head into a print starting position, and thereafter, supplies an energization signal to the thermal head in accordance with the contents of the first memory while moving the carrier, thereby enabling printing, while the carrier is driven in either direction.

According to the present invention, the carrier may easily be moved a desired distance at high speed, since the drive unit for driving the printing ribbon is provided apart from the carrier. Furthermore, since the ribbon is accurately fed by a distance determined by the contents of the second and third memories, the ribbon is used efficiently.

BRIEF DESCRIPTION OF THE DRAWINGS

FIG. 4 shows a memory map of a RAM which is used in the electronic circuit section shown in FIG. 3;

FIGS. 5 and 6 are explanatory views showing the positional relationship between the thermal head and the printing ribbon;

DETAILED DESCRIPTION OF THE PREFERRED EMBODIMENT

Figure 1A:
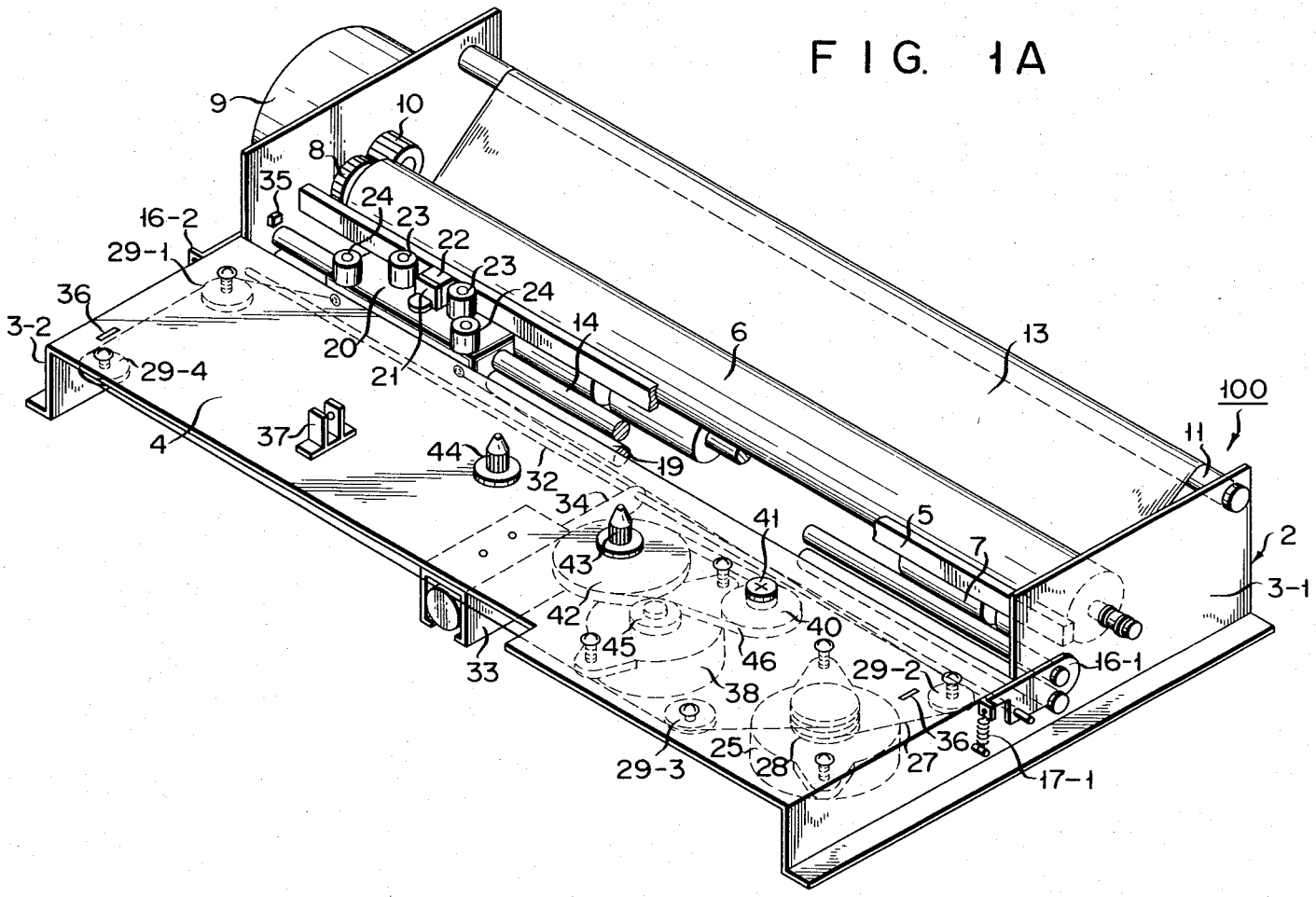
FIGS. 1A and 1B illustrate the mechanical sections serving as the main parts of a thermal printer according to one embodiment of the present invention.
Figure 1B:
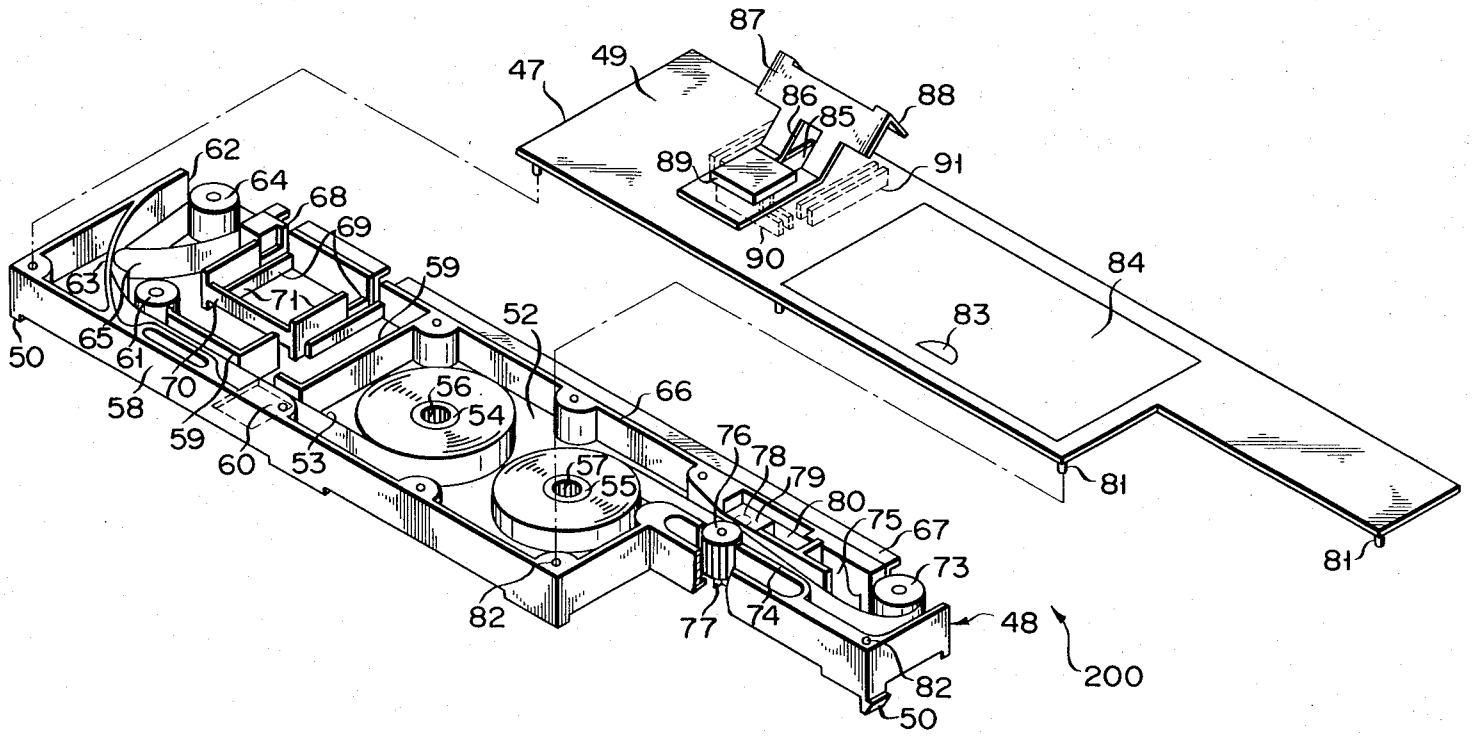
Figure 2:
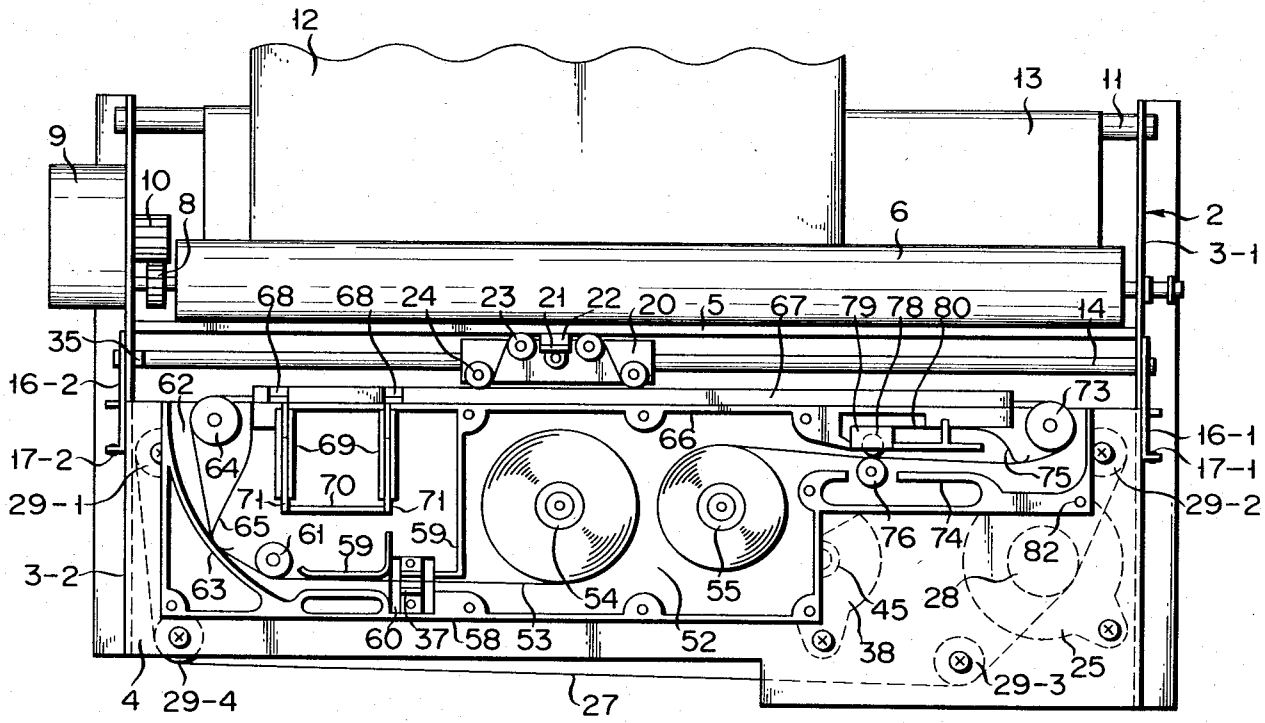
FIG. 2 is a plan view showing a printer main body to which a cassette body was mounted.

FIGS. 1A, 1B and 2 illustrate the main parts of the mechanical sections of a thermal printer according to one embodiment of the present invention. The thermal printer includes a printer main body 100 shown in FIG. 1A and a ribbon cassette 200 shown in FIG. 1B. The printer main body 100 is provided with a frame 2 which has side plates 3-1 and 3-2 which are so arranged as to face each other, and a ribbon cassette attaching plate 4 provided between the front portions of these side plates 3-1 and 3-2. A printing platen 5 having a rectangular cross section is provided and fixed between the central portions of the side plates 3-1 and 3-2. In the location behind this platen 5, a circular platen 6 for feeding a recording paper is supported between the side plates 3-1 and 3-2 to freely rotate around its axis. Pinch rollers 7 which come into pressure contact with the platen 6, by means of arms (not shown), are arranged in the locations behind the recording paper feeding platen 6. A platen drive gear 8 is attached to the left end portion of the recording paper feeding platen 6 in FIG. 1A. A drive gear 10 adapted to be driven by a paper feed motor 9 attached to the outer side surface of the side plate 3-2 is engaged with the platen drive gear 8. A paper guide attaching shift 11 is provided and fixed between the rear-upper portions of the side plates 3-1 and 3-2, and a paper guide plate 13 to feed a recording paper 12 into between the platen 5 and the pinch roller 7 is attached to this shift 11.

At the location in front of the platen 5, a main carrier shaft 14 is provided in parallel with the platen 5, between the side plates 3-1 and 3-2 to freely rotate around its axis. Both ends of the main carrier shaft 14 project outwardly from the side plates 3-1 and 3-2 and are supported. Lever-like carrier rotating members 16-1 and 16-2 for rotating a carrier (to be described later) around the carrier shaft 14, are fixed to both ends of the carrier shaft 14, respectively. The carrier rotating members 16-1 and 16-2 are pushed by springs 17-1 and 17-2, respectively, in such a direction as to separate a thermal head (to be described later) from the platen 5. Furthermore, below the main carrier shaft 14, an auxiliary carrier shaft 19 is provided, whose both end portions are fixed to the carrier rotating members 16-1 and 16-2 through an opening formed in the side plates 3-1 and 3-2. A carrier 20 is attached to the auxiliary carrier shaft 19 and the main carrier shaft 14 to freely slide in the axial directions of these shafts. A thermal head 22 is attached on the central portion of the upper surface of the carrier 20, and the thermal head 22 is arranged in such a manner that a radiator 21 is attached to its rear surface and its front surface faces the platen 5. A pair of ribbon pressure rollers 23, each having a height larger than the width of a printing ribbon, are rotatably attached to the positions on both sides of the thermal head 22. In front of these ribbon pressure rollers 23, a pair of ribbon feed-in rollers 24 are rotatably attached to the carrier 20.

A carrier drive motor 25 comprising a pulse motor which can rotate in the forward and reverse directions is screwed onto the right lower side surface of the ribbon cassette attaching plate 4. The carrier drive motor 25 is formed with a carrier drive pulley 28, around which a carrier drive wire 27 is stretched. Furthermore, four wire guide rollers 29-1 to 29-4 are rotatably attached to the lower side surface of the ribbon cassette attaching plate 4, with two of the wire guide rollers 29-1 and 29-2 being located closely to both ends of the platen 5 and on both end portions of the ribbon cassette attaching plate 4. Both end portions of the carrier drive wire 27 which is wound around the carrier drive pulley 28 and stretched on the wire guide rollers 29-1 to 29-4 are fixed to the carrier 20 by wire fixing screws.

Furthermore, a carrier rotating shaft 32 is provided, whose both end portions are fixed to the carrier rotating members 16-1 and 16-2 through the opening formed in the side plates 3-1 and 3-2. A solenoid 33 is attached to the central lower side surface of the ribbon cassette attaching plate 4, and one end of a movable core 34 of this solenoid 33 is coupled to the substantially central portion of the carrier rotating shaft 32. Thus, when the solenoid 33 is energized, the movable core 34 is pulled in, causing the shafts 19 and 32 to be rotated around the shaft 14.

A print starting position setting switch 35 for setting the home position of the carrier 20 is provided on the inside surface of the side plate 3-2. Moreover, rectangular holes 36 for fixing the cassette are formed in the end portions of the ribbon cassette attaching plate 4. In addition, a photo interrupter 37 to be used as a photoelectric detector having, for example, a light emitting diode and a phototransistor for photoelectrically detecting the presence of the ribbon is attached on the upper surface on the slightly left side from the central portion of the ribbon cassette attaching plate 4. This photo interrupter 37 generates a detection signal when detecting that the printing ribbon 53 has been exhausted, or a transparent tape coupled to the end of this printing ribbon 53 has appeared.

A drive motor 38 is attached by means of screws, between the solenoid 33 and the carrier drive motor 25, to the lower side surface of the ribbon cassette attaching plate 4. A drive pulley 40 is rotatably attached to the plate 4 on the right side of this drive motor 38 and a coupling shaft 41 is formed on the central upper portion of the drive pulley 40. The coupling shaft 41 protrudes upwardly from the ribbon cassette attaching plate 4 and is formed with a cross-shaped recess in the top portion. In addition, a ribbon take-up drive pulley 42 is attached to the plate 4 on the left side of the drive motor 38 and a ribbon take-up drive shaft 43 which protrudes upwardly is formed on the central upper portion of the drive pulley 42. A rotary guide shaft 44 is rotatably attached to the position located on the left side by a predetermined distance from the ribbon take-up drive shaft 43. However, a timing belt 46 is stretched around a timing belt drive shaft 45 of the drive motor 38 and the drive pulleys 40 and 42, so that the rotational motion of the drive motor 38 is transferred through the drive shaft 45 and belt 46 to the drive pulleys 40 and 42. The outer circumferential surface of the drive pulley 42 is smoothly ground and is preset in such a way that the timing belt 46 slips when the load to be applied to this pulley 42 is increased.

A ribbon cassette 200 includes a cassette main body 48 and a cassette lid 47. The cassette main body 48 is formed with two cassette nails 50 adapted to engage the cassette fixing holes 36 formed in the ribbon cassette attaching plate 4, the cassette main body 48 being detachably mounted on the ribbon cassette attaching plate 4.

A ribbon receiving section 52 is formed in the substantially central section of the cassette main body 48. Within this ribbon receiving section 52 are arranged a winding shaft 54, which serves to wind the unused printing ribbon 53 in a roll and hold it, and a take-up shaft 55, which serves to take up the used printing ribbon 53. These shafts 54 and 55 are formed with holes 56 and 57 adapted to engage the rotary guide shaft 44 and ribbon take-up drive shaft 43 fixedly in the rotating direction, respectively.

On the left side of the ribbon receiving section 52, guide plates 59 adapted to guide the printing ribbon 53 in cooperation with a front wall 58 are provided at a distance from each other. An inserting hole 60 adapted to receive the photo interrupter 37 is formed in the bottom plate of the cassette between these guide plates 59. A ribbon guide roller 61 is rotatably attached to the bottom plate of the cassette at the ribbon feeding end portion of the guide plate 59, and a curved guide plate 63 is formed in the portion extending from this ribbon guide roller 61 to a ribbon outlet 62. A ribbon guide roller 64 is disposed near the ribbon outlet 62. Furthermore, a tension leaf spring 65 is provided to apply a run resistance to the ribbon 53 by spring-loadedly sandwiching the printing ribbon 53 between the rollers 61 and 64 in cooperation with the guide plate 63. Moreover, a ribbon guide member 67 having a ⊔-shaped cross section is attached to the outer surface of a rear wall 66 on the other side of the cassette main body 48 and is fixed thereto at least two points. This ribbon guide member 67 may be simultaneously and integrally molded to the cassette main body 48. Near the ribbon guide roller 64, this ribbon guide member 67, along with the rear wall 66, is partially cut away, to thereby form two cut-out portions 68. Two sets of guide members 69 are formed, defining guide paths which communicate with these cut-out portions 68. A pair of ribbon extruding members 71 coupled by a coupling portion 70 are respectively guided by the two sets of guide membrs 69, and are so provided as to freely project from the rear wall 66.

A ribbon guide roller 73 is rotatably attached to the bottom plate of the cassette adjacent to the ribbon guide member 67. A guide member 74 defining a guide path to guide the printing ribbon 53 is formed in the section extending from the ribbon guide roller 73 to the ribbon receiving section 52. A tension leaf spring 75 adapted to apply the spring load to the printing ribbon 53 in the direction of the guide member 74 is formed in the location immediately in front of the entrance to the guide member 74. A drive roller 76 is rotatably attached in the central section of the guide path formed by the guide member 74, and a projecting portion 77 adapted to engage the coupling shaft 41 is formed on the lower end portion of the drive roller 76. An auxiliary roller 78 is attached to face the drive roller 76. The auxiliary roller 78 is rotatably held to a block-like supporting member 79 which is so attached as to freely reciprocate in a direction perpendicular to the running direction of the printing ribbon 53. The supporting member 79 is spring-loaded in the direction towards the drive roller 76 by a pressure spring 80 formed integrally with the tension leaf spring 75.

The cassette lid 47 has a lid plate 49 which is formed with a plurality of projections 81 on its circumferential lower surface. These projections 81 are inserted into cassette lid fixing holes 82 formed in the cassette main body 48. The lid plate 49 is provided with a small lid 84 having a recess 83 and provided in the location corresponding to the ribbon receiving section 52. An opening portion 85 is formed in the lid plate 49 in the location corresponding to the ribbon extruding member 71. A ribbon pushing member 87 having a long hole 86 corresponding to the opening portion 85 is formed on the lid plate 49. The base portion of the ribbon pushing member 87 is attached to the lid plate 49 and its intermediate portion is elastically curved upwardly; and two pieces of ribbon pushing members 88 are perpendicularly coupled at both ends of its top portion. A knob 89 which is adapted to penetrate the opening portion 85 and the long hole 86, the upper portion of which is located on the upper surface of the ribbon pushing member 87, is so provided as to be freely slidable in either direction. A holding portion 90 serving to sandwich the coupling portion 70 of the pair of ribbon extruding members 71 is formed on the lower portion of this knob 89. Two sets of guide members 91 adapted to guide the upper edge portions of the pair of ribbon extruding members 71 are formed on the lower surface of the lid plate 49. These guide members 91 have the same shapes as those of the guide members 69 formed on the cassette main body 48.

Figure 3:
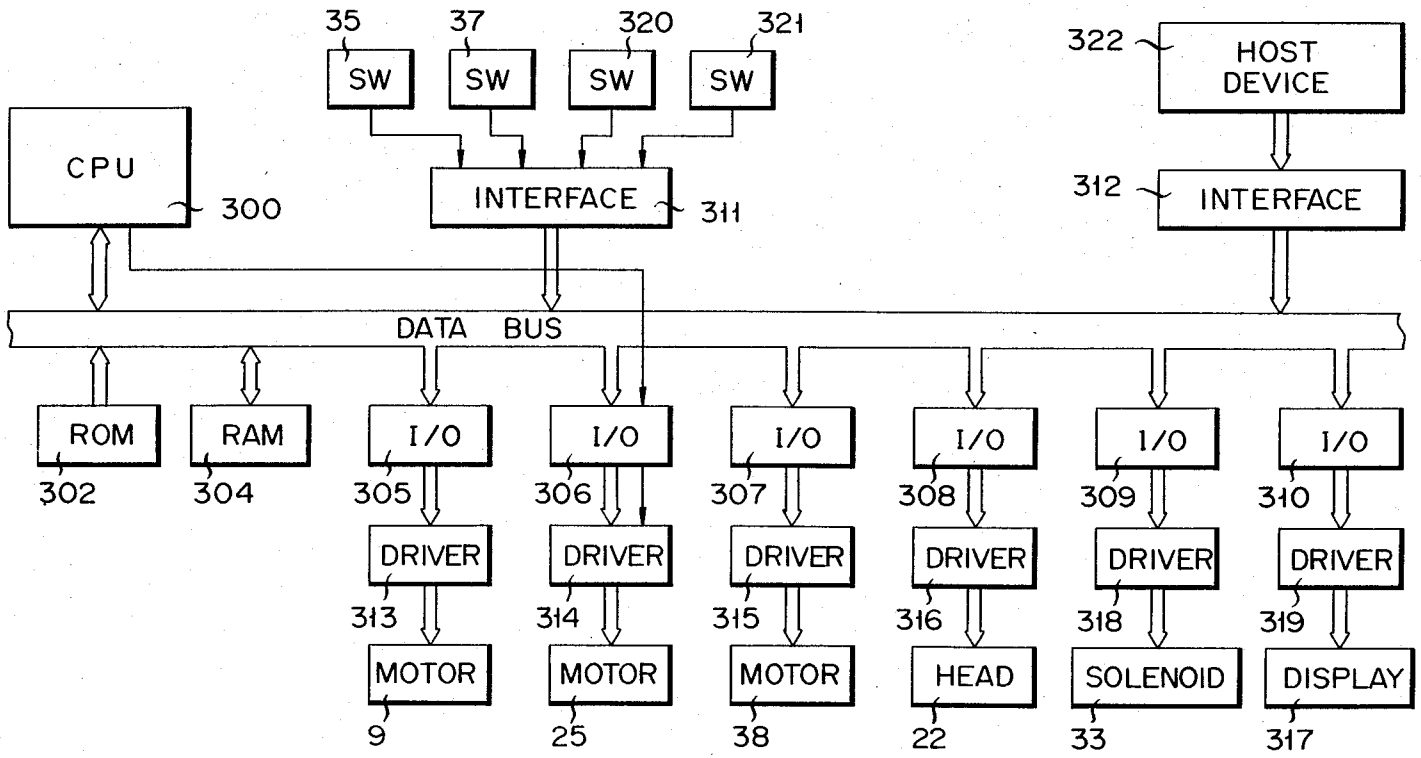
FIG. 3 shows an electronic circuit section of the thermal printer according to one embodiment of the present invention.

FIG. 3 shows an electronic circuit section of a thermal printer according to one embodiment of the present invention. This electronic circuit section includes a central processing unit (CPU) 300, and a read only memory (ROM) 302 and random access memory (RAM) 304 which are connected through a data bus to the CPU 300. Furthermore, I/O ports 305 to 310, and interface circuits 311 and 312 are connected, through the data bus, to the CPU 300. The drive motors 9, 25 and 38, and the thermal head 22 are respectively coupled to the I/O ports 305 to 308 through driver circuits 313 to 316. The solenoid 33 and an error display unit 317 are connected to the I/O ports 309 and 310 through driver circuits 318 and 319. Furthermore, the switch 35 serving to set the print starting position, the photo interrupter 37 which produces a detection signal when detecting the absence of the printing ribbon 53, a switch 320 serving to feed the ribbon, and a switch 321 serving to feed the paper are coupled to the interface circuit 311. A host device 322 for generating data to be printed, such as characters, alphanumeric characters, etc., as well as function data, is coupled to the interface circuit 312. This host device 322 is constituted by a keyboard circuit including, for example character keys, ten keys, function keys, etc., or a data generator for generating desired data.

FIG. 4 shows a memory map of the RAM 304. This RAM 304 includes memory areas SPL and DL to store data relating to the distances from the left end of the printable area to the print starting position and to the print end position; memory areas SPLP and DLP to store the position data of the carrier 20 corresponding to the data in the memory areas SPL and DL; a memory area SPLO to store the data stored in the memory area SPLP in the preceding print cycle; a memory area DOTC to store data indicative of the total length of a character or characters to be printed; a memory area RPC to store data concerning the distance the ribbon is to be moved; and a memory area CHP to store data regarding the position of the carrier 20 after printing operation with the position located on the left side by n steps apart from the left end of the printable area being set as the reference position. After the print has been executed to the right, the sum of the content of the memory area DLP and numeric value 2n is written into the memory area CHP; while, after the print has been executed to the left, the contents of the memory area SPLP are written into the memory area CHP. Now, assuming that one dot is printed laterally at every driving step of the motor 25, the contents of the memory areas SPL and DL are written into the memory areas SPLP and DLP.

The RAM 34 is further provided with a memory area SDR to store the results obtained when the contents of the memory area SPLP were subtracted from the contents of the memory area CHP, and a memory area SDL to store the results obtained when the contents of the memory area CHP were subtracted from the sum of the contents of the memory area DLP and numeric value 2n.

The operation of the thermal printer shown in FIGS. 1 to 4 will now be described as follows.

Figure 7A:
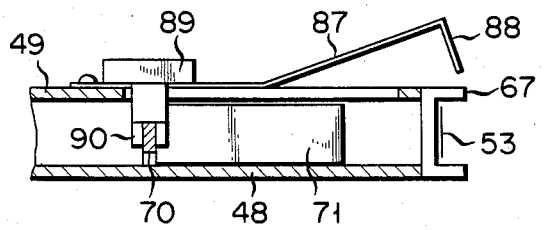
FIGS. 7A to 7C are explanatory views showing the procedure for setting the printing ribbon along the thermal head, as shown in FIGS. 5 and 6.
Figure 7B:
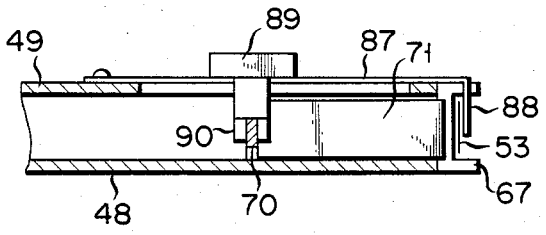
Figure 7C:
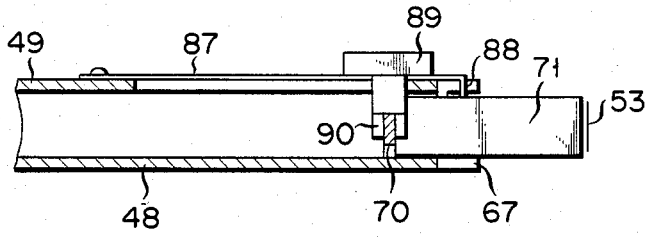
Figure 8:
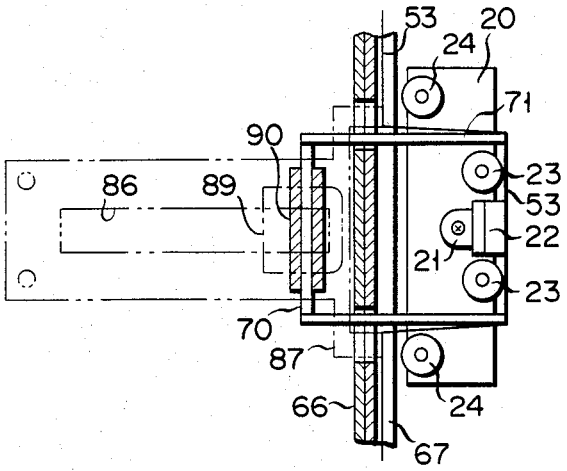
FIG. 8 is a diagram showing the positional relationship between the ribbon and the thermal head shown in FIG. 7C.
Figure 9:
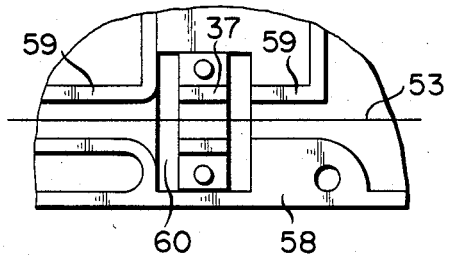
FIG. 9 is an explanatory view showing the positional relationship between a photo-interrupter and the printing ribbon after the cassette body has been mounted on the printer's main body.

First, the operation of mounting the ribbon cassette 200 in the printer main body 100 is described. In the normal state, the printing ribbon 53 is stretched in a straight line by the ribbon guide member 67, from the ribbon outlet 62 to the guide roller 73. To attach the ribbon cassette 200 in which the printing ribbon 53 has been enclosed in this way on the ribbon cassette attaching plate 4, as shown in FIGS. 5 and 6, it is required that the printing ribbon 53 is guided in the direction of the thermal head 22 by the pair of ribbon feed-in rollers 24 and at the same time, it is guided by the pair of ribbon pressure rollers 23 so as to come into contact with the front surface of the thermal head 22. To set the printing ribbon 53 in the manner described above, the ribbon cassette 200 is operated in accordance with the procedures shown in FIGS. 7A to 7C, with the carrier 20 at a standstill, in the print starting position. When the knob 89 is pushed and advanced from the initial position shown in FIG. 7A to the intermediate position shown in FIG. 7B, the ribbon pushing member 87 is depressed, causing the pair of ribbon pushing members 88 to penetrate the pair of opening portions 68 and to be so located that they face the bottom surface of the ribbon guide member 67. When the knob 89 is further advanced as shown in FIG. 7C, the pair of ribbon extruding members 71 which cooperate with the knob 89 partially extrude the printing ribbon 53. In this case, as clearly illustrated in FIG. 8, only that portion of the ribbon 53 which is sandwiched between the ribbon pushing members 88 is extruded. Once the ribbon cassette 200 has been attached to the ribbon cassette attaching plate 4, after the above-mentioned preparations are completed, the relative position between the printing ribbon 53 and the thermal head 22 is accurately determined by inserting the cassette setting nails 50 into the cassette fixing holes 36. Specifically, as shown in FIG. 8, the printing ribbon 53 is relocated from the inside portion of the ribbon feed-in rollers 24 to the outside portions of the ribbon pressure rollers 23 and thermal head 22. In this case, as shown in FIG. 9, the photo interrupter 37 enters the ribbon cassette 200 through the opening portion 60 and is set into the ribbon detecting position. When the knob 89 is returned backwardly, after the ribbon cassette 200 has been attached to the cassette attaching plate 4, the ribbon extruding members 71 are brought inside, so that the ribbon pushing member 87 springs back upwardly, due to its inherent self-elastic force, allowing the ribbon pushing members 88 to be released from the printing ribbon 53. At this time, although some slack may be caused, this slack will be eliminated by advancing the ribbon, as will be described below.

Next, the feeding operation of the printing ribbon 53 will be described. Although the winding shaft 54 around which the unused printing ribbon 53 has been wound engages the rotary guide shaft 44, it is freely rotatable. The take-up shaft 55 to wind the used printing ribbon 53 engages the ribbon take-up drive shaft 43. The engaging projecting portion 77 of the ribbon pull-in drive roller 76 is coupled to the coupling shaft 41 of the ribbon pull-in drive pulley 40. When a command to feed the printing ribbon 53 is produced by e.g. operation of the switch 320, the ribbon pull-in drive motor 38 is rotated. Thus, the driving force is transferred through the timing belt 46 to the ribbon pull-in drive pulley 40 and the ribbon take-up drive pulley 42. At this time, the ribbon pull-in drive pulley 40 is driven synchronously with the ribbon pull-in drive motor 38, allowing the ribbon pull-in drive roller 76 to rotate through the coupling shaft 41, thereby pulling in the printing ribbon 53. At the same time, the ribbon take-up drive pulley 42 is also driven and the ribbon take-up drive shaft 43 drives the take-up shaft 55 in such a way as to wind up the printing ribbon 53 thus pulled in. In this case, the rotation ratios of the pulleys 40 and 42 are set at a proper value, so that, even when the diameter of the printing ribbon 53 which has been wound around the take-up shaft 55 is minimal, a sufficient amount of the ribbon which was pulled in by the ribbon pull-in drive roller 76 can be taken up. Therefore, the tensile force of the printing ribbon 53 between the take-up shaft 55 and the ribbon pull-in drive roller 76 increases with an increase in diameter of the printing ribbon 53 on the take-up shaft 55. However, when a tensile force larger than a predetermined value occurs in the printing ribbon 53 of this portion, the load to be applied to the drive pulley 42 increases, causing a slip between the timing belt 46 and the ribbon take-up drive pulley 42. Thus, only the printing ribbon 53 which has been pulled in is taken up smoothly.

The setting operation of the recording paper 12 will now be described. When the paper feed motor 9 is first driven by operating the switch 321, after the paper 12 has been inserted along the paper guide plate 13, the circular platen 6 for feeding the paper is rotated. Thereby, the paper 12 slides along the paper guide plate 13 and is automatically fed to the front of the platen 5. At this time, since the solenoid 33 is not yet energized, the carrier rotating members 16-1 and 16-2 are in the state in which they are pulled by the thermal head pulling back springs 17-1 and 17-2. Thus, the carrier 20 is set to the position to which it was rotated by a predetermined angle, counterclockwise around the main carrier shaft 14, as seen from the right in FIGS. 1A and 1B; and the thermal head 22 is separated from the platen 5. Therefore, the paper 12 can be smoothly inserted without any trouble. Once the paper 12 has been inserted, its line spacing is done by rotation of the circular paper feeding platen 6, which is to be driven by the paper feed motor 9 before commencement of the printing operation.

For movement of the carrier 20, i.e., for movement of the thermal head 22, the carrier drive motor 25 is rotated to drive the carrier drive wire 27, and the carrier 20 is thereby moved along the main and auxiliary carrier shafts 14 and 19. The thermal head 22 is moved a given distance in either direction, while accurately synchronizing with the operation of the carrier drive motor 25. Once the printing operation is commenced, the carrier 20 is automatically moved to the left end; and, by turning on the print starting position setting switch 35, the reference position is determined and the carrier 20 is then set to the print starting position which is a predetermined distance away from the reference position. This setting operation is performed by applying pulses of a predetermined number to the carrier drive motor 25 comprising a pulse motor.

The solenoid 33 is energized to set the carrier 20 which moves in the manner described above to the printable condition. Hence, the carrier rotating members 16-1 and 16-2 are rotated clockwise, as viewed from the right in FIGS. 1A and 1B through the solenoid drive shaft 34 and carrier rotating shaft 32. As a result, the auxiliary carrier shaft 19 changes its position, thereby pressing the thermal head 22 toward the platen 5. Of course, the thermal head 22 is pressed against the printing ribbon 53, since the paper 12 and printing ribbon 53 exist on the surface of the platen 5. In this state, the printing is executed while moving the thermal head 22.

The fundamental printing operation may be described as follows. First, the printing ribbon 53 is stretched along the paper 12 and is set in such a way that there is no relative movement between the ribbon 53 and the paper 12. Then, the thermal head 22 is brought into contact with the printing ribbon 53. At this time, the plurality of heating elements provided on one column of the thermal head 22 are selectively energized, allowing them to be selectively heated, thereby partially melting the thermally melting ink to be transferred on the paper 12. Then, the printing ribbon 53 is separated away from the paper 12, to produce printed characters. When performing such a printing operation, the necessary conditions are that: the printing ribbon 53 is pressed against the paper 12 by the thermal head 22, even when the thermal head 22 moves; no relative movement occurs between the printing ribbon 53 and the paper 12; and the printing ribbon 53 is immediately separated from the paper 12, after the ink has been transferred due to thermal fusion.

Figure 10A:
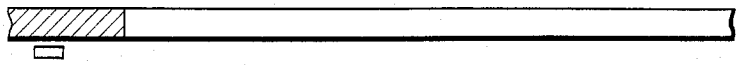
FIGS. 10A to 10J are explanatory views to show the process of feeding the ribbon in response to the print data and the process of setting the thermal head to the print starting position.
Figure 10B:
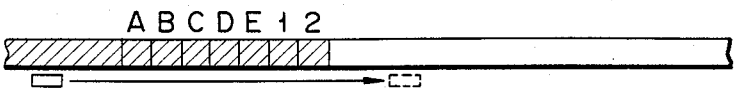

The printing operation shown in FIGS. 10A to 10J may now be described with reference to the flowcharts shown in FIGS. 11A and 11B.

Upon initialization, "0" is written into each of the memory areas SPL, SPLO, CHP, FL, and DOTC. Then, assuming that a print start command signal was generated from the host device 322, the CPU 300 supplies a drive pulse and a direction instruction signal through the I/O port 306 to the motor drive 314, to drive the motor 25 and to move the carrier 20 to the left, until the switch 35 is turned on. When it is detected that the switch 35 is turned on, the CPU 300 supplies drive pulse data representing drive pulses of a predetermined number to the motor driver 314, thereby allowing the carrier 20 to move to the right and to be set at the initial location. As shown in FIG. 10A, it is now assumed that the thermal head 22 has been set at the print starting position and faces the printing ribbon 53 at the position a distance of n dots away to the left from the front end of the unused portion (hatched area) of the printing ribbon 53. This numeric value n represents the number of pulses to be applied to this motor 25 to change the motor 25 from the stopping state to the steady-rotating state before commencement of the printing operation; or, the number of pulses to be applied to the motor 25 when the motor 25 is changed from the rotating state, at a constant speed, to the stopping state. In this example, $n=3Y$ (where, $Y$=number of dots allotted for each character space in a line direction). Now, the case will be considered wherein the print data of seven characters "A, B, C, D, E, 1, 2" was supplied from the host device 322. In this case, the CPU 300 stores the first character data from the host device 322 in the data storing area in the RAM 304 and writes "1" in the flag area FL, and the dot number data of Y is added to the contents of the memory area DOTC. In this way, when all of the 7-character print data are stored in the data storing area of RAM 304, the dot number data of $7\times Y$ corresponding to the distance of 7 characters is stored in the memory area DOTC. Thereafter, the CPU 300 writes the sum of the contents of the memory areas SPL and DOTC into the memory area DL, in response to a print start instruction from the host device 322; and, subsequently, it writes the contents of the memory areas SPL and DL into the memory areas SPLP and DLP. Next, in STEP 1, the contents of the memory area DLP are checked to see if, they are larger than the contents of memory area SPLP. In this example, it is detected that this data "DLP" is larger than the data "SPLP", so that the data indicative of the number of ribbon driving steps corresponding to the data ("DLP"−"SPLO") is written into the memory area RPC. The CPU 300 supplies the contents of this memory area RPC to the motor driver 315, through the I/O port 307, and applies the pulses of the number corresponding to the contents of this memory area RPC to the motor 38. Thus, as shown in FIG. 10B, the printing ribbon 53 is fed to the right by a distance corresponding to the seven characters. Following this, the contents of the memory area SPLP is written into the memory area SPLO. On the other hand, if it is detected in STEP 1 that the data "DLP" is not larger than the data "SPLP", the contents of the memory area SPLP are also written into the memory area SPLO. Thereafter, in STEP 2, the result obtained when the contents of the memory area SPLP are subtracted from the contents of the memory area CHP is stored in the memory area SDR and the contents of this memory area SDR is checked whether it is positive or not. If the answer is "YES" in STEP 2, the contents of the memory area CHP are subtracted from the sum of the contents of the memory area DLP and the numeric value 2n and then the result is stored in the memory area SDL in STEP 3, and the contents of this memory area SDL are checked as to whether or not they are positive. If the answer is "YES" in STEP 3; the contents of the memory area SDL are checked as to whether or not they are larger than the contents of memory area SDR or not in STEP 4. If the answer is "NO" in STEP 4, the CPU 300 makes the motor 25 rotate forwardly by that number of steps which is determined in accordance with the contents of the memory area SDL to move the carrier 20 to the right by that distance corresponding to the rotation of the motor 25. Thereafter, in STEP 5, the CPU 300 makes the motor 25 rotate in a reverse direction by the number of steps which is equivalent to the number of dots determined in accordance with the contents of the memory area DOTC, and supplies the dot data corresponding to the 7-character data which has been stored in the data storing area of the RAM 304 to the head driver 316, through the I/O port 308 at every step-drive to thereby selectively supply a heating current to the heating elements of the thermal head 22. Thereafter, the contents of the memory area SPLP is transferred to the memory area CHP and is finally cleared. If the answer is "NO" in STEP 3, the processing in STEP 5 is also carried out.

If the answer is "YES" in STEP 4, the CPU 300 makes the motor 25 rotate in a reverse direction by the number of steps required in response to the contents of the memory area SDR to move the carrier 20 to the left by a distance corresponding to the rotation of the motor 25. Thereafter, in STEP 6, the CPU 300 makes the motor 25 rotate forwardly by the number of steps equivalent to the number of dots determined in accordance with the data of $7\times Y$ of the memory area DOTC. In this case, the CPU 300 energizes the solenoid 33 and supplies, at every step-drive, the dot data corresponding to the 7-character data stored in the data storing area of the RAM 304 to the head driver 316, through the I/O port 308, and then selectively supplies the current to the heating elements of the thermal head 22. In STEPs 5 and 6, the sequences used to read out the dot data from the RAM 304 by the CPU 300 are opposite to each other.

As described above, in the example shown in FIG. 10B, the contents of both memory areas CHP and SPLP are "0", so that the answer in STEP 2 is "NO"; and, thereafter, the processing of STEP 6 is executed. As mentioned above, in this STEP 6, the dot data constituting the 7-character data of "A, B, C, D, E, 1, 2" is printed in this sequence. Upon completion of the printing operation is STEP 6, the sum of the data of $7\times Y$ of the memory area DLP and the numeric value 2n is stored in the memory area CHP, and then the contents of the memory areas SPLP and DOTC are cleared.

Figure 10C:
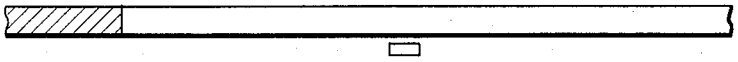
Figure 10D:
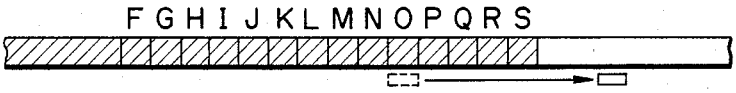
Figure 11A:
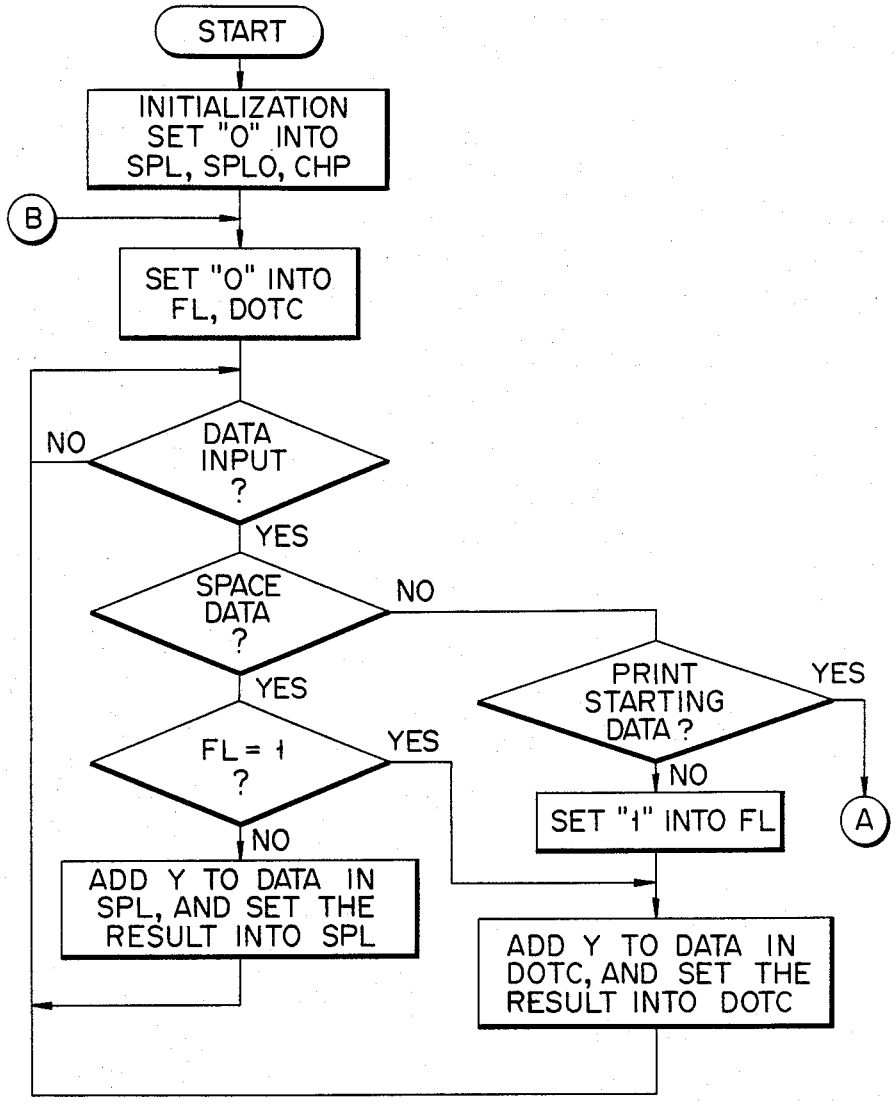
FIGS. 11A and 11B are flowcharts showing the processes of feeding the ribbon and of setting the position of the head.
Figure 11B:
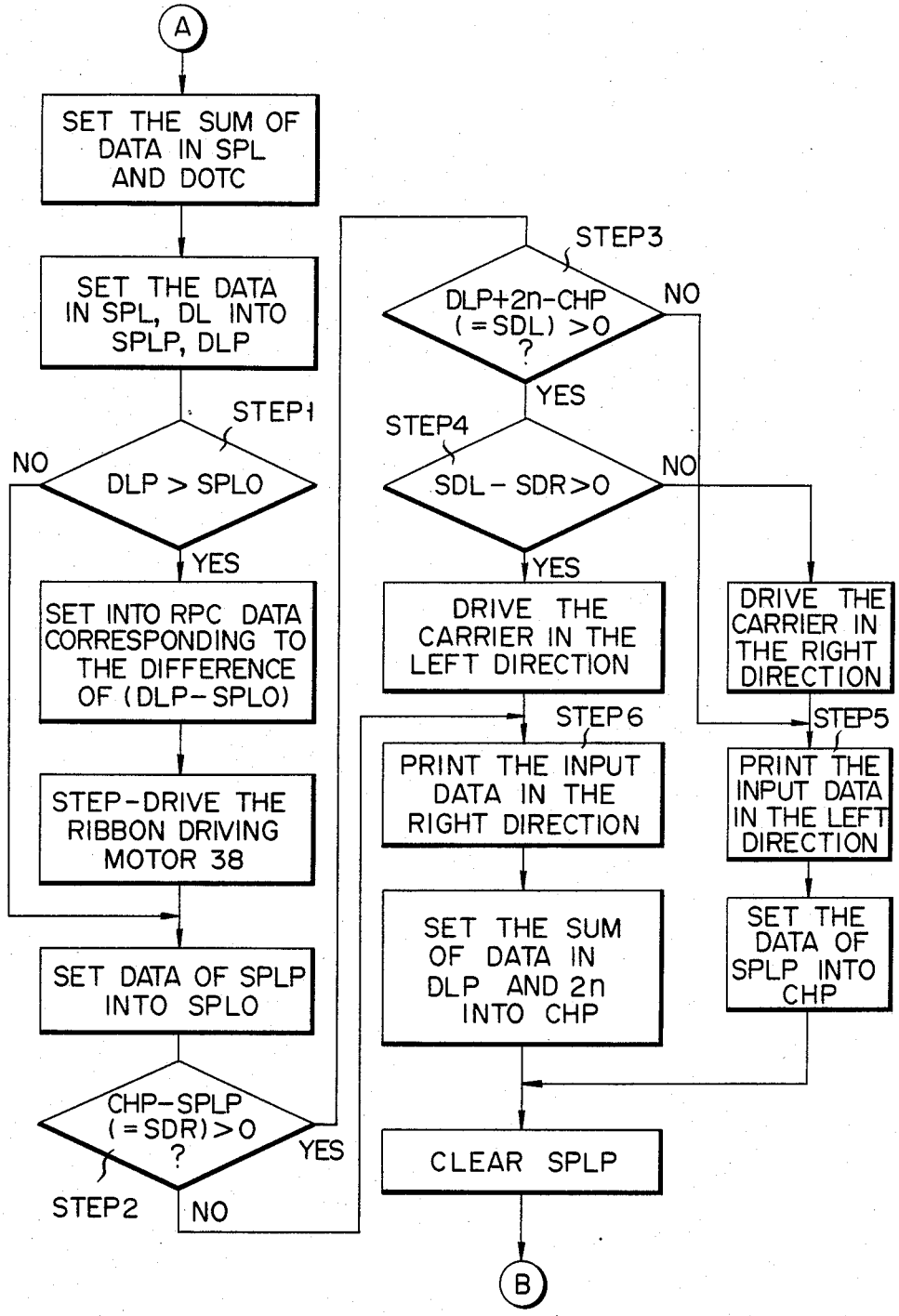

In this way, after the 7-character data of "A, B, C, D, E, 1, 2" has been printed, the front end of the unused portion of the printing ribbon 53 is set to the original position as shown in FIG. 10C, and the thermal head 22 is set to the position that is at a distance corresponding to the sum of the 7 characters and numeric value 2n, away to the right from the initial position. In this state, it is assumed that the 14-character data of "F, G, H, I, J, K, L, M, N, O, P, Q, R, S" is supplied from the host device 322. When the CPU 300 detects that the data to be printed is entered, it step-drives the motor 9 to line-advance the recording paper 12 by one line and, at the same time, it stores the dot number data of 14×Y in the memory area DOTC. Thereafter, in the same manner as described above, the dot number data of 14×Y is written into the memory area SPLP. In this example, since the contents of the memory area SPLO, the data representative of the number of ribbon drive steps corresponding to the data of 14×Y, which is the difference between both contents, is written into the memory area RPC. The CPU 300 supplies the drive data to the motor driver 315 in accordance with the contents of the memory area RPC, to step-drive the motor 38, thereby feeding the printing ribbon 53 to the right by the distance equivalent to the 14 characters, as shown in FIG. 10D. Now, since "7×Y+2n", "0" and "14×Y" are stored in the memory areas CHP, SPLP and DLP, respectively, the answers in STEPs 2 and 3 are both "YES", so that the processing of STP 4 is performed. In this case, since "7×Y+2n" and "7×Y" are stored in the memory areas SDR and SDL, respectively, the answer in STEP 4 is "NO". Therefore, the CPU 300 makes the motor 25 rotate forwardly by the number of steps in accordance with the data of "7Y" in the memory area SDL, to move the carrier 20 to the right by the distance corresponding to the rotation of the motor 25. Thereafter, in STEP 5, the CPU 300 makes the motor 25 rotate in a reversel direction by the number of steps which is equal to the number of dots corresponding to the data obtained by adding the numeric value 2n to the data of 14×Y in memory area DOTC, and reads out the 14-character data stored in the RAM 304 in a reverse direction at every step-drive when the motor 25 is driven at a constant speed. Then, the CPU 300 supplies the corresponding dot data to the head driver 316 and selectively supplies the current to the heating elements of the thermal head 22.

Figure 10E:
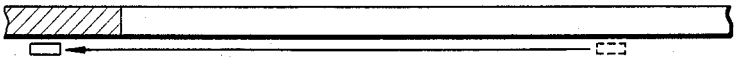
Figure 10F:
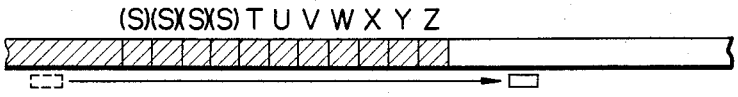

In this way, after the 14-character data is printed on the second line, the front end of the unused portion of the printing ribbon 53 is set to the original position as shown in FIG. 10E and the thermal head 22 is set to the initial position. In this state, assume that the data of "(s), (s), (s), (s), T, U, V, W, X, Y, Z", which is representative of the four character spaces and seven characters is supplied from the host device 322. At this time, the CPU 300 line-advances the recording paper 12 by one line, stores the dot number data of "4×Y" in the memory area SPL and, thereafter, stores the dot number data of "7×Y" in the memory area DOTC. Furthermore, "11×Y" is stored in the memory areas DL and DLP, the data of "4×Y" is stored in the memory areas SPl and SPLP, and the data indicative of the number of ribbon drive steps corresponding to "11×Y" is stored in the memory area RPC. The printing ribbon 53 is moved to the right by a distance of 11 characters in accordance with the data in this memory area RPC, as shown in FIG. 10F.

On the other hand, the data of "4×Y" in the memory area SPLP is stored in the memory area SPLO. In this example, since the data larger than that in the memory area CHP is stored in the memory area SPLP, the CPU 300 makes the carrier 20 move at a constant speed to the right by the distance corresponding to the contents of the memory area SPL and, thereafter, prints the 7-character data of "T, U, V, W, X, Y, Z", while moving the carrier 20 at a constant speed to the right by the distance corresponding to the contents of the memory area DOTC. Next, the data of "11×Y+2n", the sum of the numeric value 2n and the data of "11×Y" in the memory area DLP, is written in the memory area CHP.

Figure 10G:
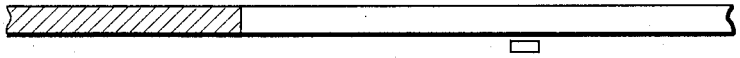

Upon completion of this printing operation, the front end of the unused portion of the printing ribbon 53 is set to the position that is separated to the right by a distance corresponding to the number of dots of "4×Y" from the initial position as shown in FIG. 10G, and the thermal head 22 is set to the position that is at a distance corresponding to the number of dots of "11×Y+2n", apart and to the right from its initial position.

Figure 10H:
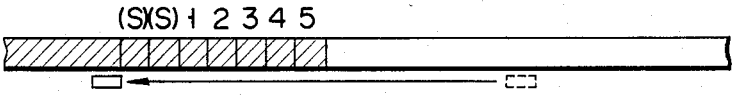

Next, in this state, assume that the data of "(s), (s), 1, 2, 3, 4, 5", including the two character spaces and five characters, is supplied from the host device 322. At this time, the CPU 300 line-advances the recording paper 12 by one line and then stores the dot number data of "2×Y" and "5×Y" in the memory areas SPL and DOTC, respectively. The data of "2×Y" is next written in the memory area SPLP and the data of "7×Y" is written in the memory areas DL and DLP. Since the memory area DLP stores dot number data larger than that in the memory area SPLO, the data representative of the number of ribbon drive steps corresponding to the difference "3×Y" of the data in these memory areas DLP and SPLO is stored in the memory area RPC. Thus, the printing ribbon 53 is fed to the right by the distance corresponding to the dot number data of "3×Y", as shown in FIG. 10H. In this example, since the memory area CHP stores data larger than that in the memory area SPLP; and, since the data in the memory area CHP is larger than the value obtained by adding the numeric value 2n to the data in the memory area DLP, the CPU 300 makes the motor 25 rotate in a reverse direction by the distance corresponding to the dot number of "11×Y+2n−7×Y+n=4Y+n", to move the carrier 20 to the left. Thereafter, the CPU 300 further allows the carrier 20 to move to the left at a constant speed, and then reads out the 5-character data of "1, 2, 3, 4, 5" from the RAM 304, in the sequence opposite to the write sequence, to print this read-out 5-character data. After the carrier 20 is further moved by the distance of n dots, the CPU 300 stops the carrier 20.

Figure 10I:
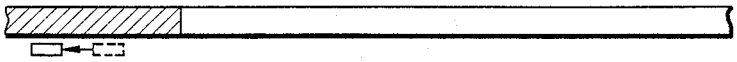
Figure 10J:
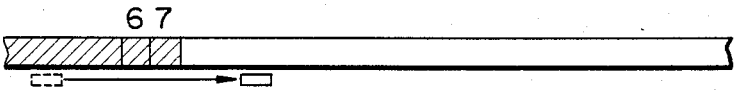

At this time, the front end of the unused portion of the printing ribbon 53 is set to the position that is at a distance of "2×Y" apart from its initial position, as shown in FIG. 10I, and the head 22 is set to the position that is at a distance of "2×Y" apart from its initial position.

Next, assuming that the 2-character data of "6, 7" is supplied from the host device 322, the ribbon 53 is held at the present position, since the contents of the memory areas DLP and SPLO are "2×Y" in this case. In addition, since the contents of the memory areas SPLP and CHP are "0" and "2×Y", respectively, the carrier 20 is moved to the left by the distance of "2×Y", as shown in FIG. 10I. Thereafter, the motor 25 is rotated forwardly by n steps, is then driven at a constant speed by 2×Y steps, is further driven by n steps, and finally stops. While this motor 25 is being driven at a constant speed by 2×Y steps, the CPU 300 reads out the 2-character data "6, 7" from the RAM 304 and sends it for printing.

Upon completion of the feeding operation by the printing ribbon 53, as described above, the CPU 300 stops the printing operation in response to the detection signal generated from the photo interrupter 37 and, at the same time, allows a ribbon end indication lamp (not shown) to light up. To exchange this ribbon, the small lid 84 for exchanging the ribbon is opened, with the ribbon cassette 48 attached to the frame 2 of the printer main body. The head of a new printing ribbon 53, which is wound is a roll, is coupled to the tail of the used printing ribbon 53, and is then set at the position of the winding shaft 54. At this time, it is necessary to remove the used portion having a larger diameter, which has been wound around the winding shaft 55. Thereafter, the ribbon pull-in drive motor 38 is driven to feed the printing ribbon 53. Hence, the new printing ribbon 53 passes in front of the thermal head 22, and its head is fed into the ribbon receiving section 52. Next, the head of the printing ribbon 53 is separated from the tail of the used printing ribbon 53, the used ribbon is removed, and the head of the new printing ribbon 53 is then coupled to the winding shaft 55. Thus, the printing ribbon 53 can be easily exchanged by simply removing the ribbon cassette 48.

This invention has been described with reference to a specified embodiment, but this invention is not limited to this specified embodiment. For example, in this embodiment, the used portion of the ribbon 53 is taken up by the pair of rollers 76 and 78 so that a selected length of unused portion of the ribbon 53 to be used for the next printing operation can be taken up. However, it is possible to omit the drive pulley 40, and use a detector for detecting the rotation angle of the roller 76 or 78. In this case, for example, it is required to dispose at least one magnet or mirror piece on the roller 76 or 78, and the detector is designed to generate an output pulse to the CPU 300 each time it detects the presence of the magnet or mirror piece. When the CPU 300 detects that pulses of a number corresponding to a distance of the ribbon 53 to be fed are generated from the detector, the CPU 300 supplies a stop signal to the motor driver 315, thus interrupting the ribbon feed operation.

What is claimed is:

1. A thermal printer comprising:

a carrier;

carrier drive means for reciprocally moving said carrier within a predetermined range;

a thermal head which is provided on said carrier and has a plurality of heating elements;

ribbon drive means, provided separately from said carrier, for driving a printing ribbon coated with a thermally melting ink in a predetermined direction, said printing ribbon being stretched to pass through between a recording medium and said thermal head;

print data generation means for generating print data for each line;

memory means having a first memory area for storing the print data from said print data generation means, a second memory area for storing data corresponding to the length of the ribbon necessary to print said print data, and a third memory area for storing the position data representative of the front end position of the unused portion of said ribbon; and a data processing circuit which applies a first control signal to said ribbon drive means, in accordance with the contents of said second and third memory areas, to feed said ribbon by the distance determined in accordance with the contents of said second and third memory areas; applies a second control signal to said carrier drive means to set said thermal head into the print starting position; and subsequently supplies an energization signal to the thermal head, in accordance with the contents of said first memory area while moving said carrier in either direction, thereby enabling the printing to proceed.

2. A thermal printer according to claim 1, wherein said ribbon drive means comprises: a pair of rollers for sending the printing ribbon passed through said thermal head in said predetermined direction; a ribbon drive motor which is rotated by only the rotational angle determined in accordance with the contents of said second and third memory areas, in response to the first control signal from said data processing circuit; and transmitting means for transmitting the rotational movement of said ribbon drive motor to said pair of rollers.

3. A thermal printer according to claim 2, wherein said transmitting means comprises: a first pulley; a belt to transmit the rotational movement of said ribbon drive motor to said first pulley; and coupling means for removably coupling said first pulley and said pair of rollers.

4. A thermal printer according to claim 3, wherein said ribbon drive motor is a pulse motor.

5. A thermal printer according to claim 3, wherein said ribbon drive means further comprises a ribbon take-up mechanism for winding the ribbon to be fed from said pair of rollers.

6. A thermal printer according to claim 5, wherein said ribbon take-up mechanism comprises: a second pulley which receives the rotational force of said motor through said belt and is rotated due to the rotational force of the motor when the level of a load applied is a predetermined value or less; a take-up shaft to wind the ribbon fed out from said pair of rollers; and coupling means for coupling said second pulley and said take-up shaft.

7. A thermal printer according to claim 2, wherein said ribbon drive motor is a stepping motor.

8. A thermal printer according to claim 2, wherein said ribbon drive means further comprises a ribbon take-up mechanism for winding the ribbon to be fed from said pair of rollers.

9. A thermal printer according to claim 1, wherein said ribbon drive means comprises a ribbon take-up mechanism for taking up the ribbon passing through said thermal head, a pair of rollers disposed to sandwitch the ribbon, and detecting means for detecting the rotation angle of said pair of rollers and producing an output signal to said data processing circuit which, when detecting in response to the output signal from said detecting means that said pair of rollers are rotated by a number corresponding to the distance determined by the contents of said second and third memory areas, produces an output signal to said ribbon take-up mechanism, thereby interrupting the ribbon feed operation.

* * * * *